US010882717B2

(12) United States Patent
Miyajima et al.

(10) Patent No.: US 10,882,717 B2
(45) Date of Patent: Jan. 5, 2021

(54) ELEVATOR NETWORK FOR EMERGENCY OPERATION

(71) Applicant: Otis Elevator Company, Farmington, CT (US)

(72) Inventors: Hiromitsu Miyajima, Chiba (JP); Daisuke Meguro, Tokyo (JP)

(73) Assignee: OTIS ELEVATOR COMPANY, Farmington, CT (US)

( * ) Notice: Subject to any disclaimer, the term of this patent is extended or adjusted under 35 U.S.C. 154(b) by 552 days.

(21) Appl. No.: 15/722,477

(22) Filed: Oct. 2, 2017

(65) Prior Publication Data

US 2019/0100407 A1 Apr. 4, 2019

(51) Int. Cl.

| | |
|---|---|
| ***B66B 5/02*** | (2006.01) |
| ***B66B 5/00*** | (2006.01) |
| ***B66B 1/34*** | (2006.01) |

(52) U.S. Cl.

CPC ..... *B66B 5/022* (2013.01); *B66B 1/3453* (2013.01); *B66B 5/027* (2013.01); *B66B 2201/40* (2013.01)

(58) Field of Classification Search

USPC ..... 187/393

See application file for complete search history.

(56) References Cited

U.S. PATENT DOCUMENTS

| | | | | |
|---|---|---|---|---|
| 5,910,763 | A | 6/1999 | Flanagan | |
| 6,356,204 | B1 | 3/2002 | Guindi et al. | |
| 7,681,696 | B2 | 3/2010 | Yamagishi | |
| 7,905,329 | B2 | 3/2011 | Urata | |
| 9,051,155 | B2 * | 6/2015 | Herkel | B66B 1/34 |
| 9,366,770 | B2 | 6/2016 | Kachi | |
| 10,530,605 | B2 * | 1/2020 | Ruvio | H04L 12/40013 |

FOREIGN PATENT DOCUMENTS

| | | | |
|---|---|---|---|
| CN | 101372301 | A | 2/2009 |
| CN | 102849555 | A | 1/2013 |
| CN | 103680072 | A | 3/2014 |
| CN | 105517098 | A | 4/2016 |
| CN | 106241522 | A | 12/2016 |
| CN | 106365007 | A | 7/2017 |
| CN | 106976777 | A | 7/2017 |

(Continued)

*Primary Examiner* — Christopher Uhlir

(74) *Attorney, Agent, or Firm* — Cantor Colburn LLP

(57) ABSTRACT

An emergency operation controller for an elevator is connected to other emergency operation controllers of their respective elevators through network, and each controller constitutes a node in the network. The controller generates and transmits an emergency condition detection message to other controllers in the network which constitute adjacent nodes to the controller when the controller detects an emergency condition, and receives an emergency condition detection message from other controllers which constitute adjacent nodes to the controller in the network when other controllers detect an emergency condition. The emergency condition detection message includes a propagation count. The propagation count is configured to be decremented by one, each time one controller transmits the emergency condition detection message to other controllers which constitute next adjacent nodes. The emergency condition detection message is continuously transmitted until the propagation count reaches to zero.

17 Claims, 15 Drawing Sheets

(56) References Cited

FOREIGN PATENT DOCUMENTS

| | | | |
|---|---|---|---|
| JP | 2002046953 | A | 2/2002 |
| JP | 2007039175 | A | 2/2007 |
| JP | 2009220935 | A | 10/2009 |
| JP | 2010228877 | A | 10/2010 |
| JP | 2014069948 | A | 4/2014 |
| JP | 2008068933 | A | 10/2017 |
| KR | 200418200 | Y1 | 6/2006 |
| WO | 2007052511 | A1 | 5/2007 |

* cited by examiner

Ack Query message:

| Data Type | Expected value |
|---|---|
| Command Type | Ack Query |
| Sender's Node ID | (1-65536: 1 per building) |
| Sender's Node Location | (Geo URI data: 1 per building) |
| Propagation Range | (X [km]) |
| Propagation Count | 1 |

Fig.2B

Ack Response message:

| Data Type | Expected value |
|---|---|
| Command Type | Ack Response |
| Receiver's Node ID | (1-65536: 1 per building) |
| Receiver's Node Location | (Geo URI data: 1 per building) |
| Propagation Count | 0 |

Fig.3B

| Data Type | value |
|---|---|
| Command Type | Ack Query |
| Sender's Node ID | 0 |
| Sender's Node Location | 140,37 |
| Propagation Range | 1 [km] |
| Propagation Count | 1 |

| Data Type | value |
|---|---|
| Command Type | Ack Query |
| Sender's Node ID | 0 |
| Sender's Node Location | 140,37 |
| Propagation Range | 1 -> 2 [km] |
| Propagation Count | 1 |

| Data Type | value |
|---|---|
| Command Type | Ack Query |
| Sender's Node ID | 0 |
| Sender's Node Location | 140,37 |
| Propagation Range | 2 [km] |
| Propagation Count | 1 |

Earthquake Detected message:

| Data Type | Expected value |
|---|---|
| Command Type | Earthquake Detected |
| Seismic Signal Type | (P/S) |
| Detected Time | (YYYY-MM-DD HH:MM:SS) |
| Detected Node ID | (1-65536: 1 per building) |
| Detected Node Location | (Geo URI data: 1 per building) |
| Previous Node ID | (1-65536) |
| Previous Node Location | (Geo URI data) |
| Propagation Count | 2 < X |

Fig.5B

ELEVATOR NETWORK FOR EMERGENCY OPERATION

TECHNICAL FIELD

The present invention relates generally to an emergency operation control for elevators connected together in a network.

BACKGROUND ART

Many earthquake emergency operation control systems have been proposed in which a plurality of seismic sensors installed in their respective elevator systems in various areas are connected via communication network to a remote monitoring center, and the monitoring center provides earthquake emergency operation control to the elevator systems in the network based on the obtained earthquake information. By connecting elevator systems in various areas through communication network, the obtained earthquake detection data can be utilized for providing early warning to remote locations in advance of the arrival of an earthquake. However, since enormous amounts of data traffic have to be handled by a central management server in the remote monitoring center, such arrangements would add high cost and complexity for maintenance and management of facility.

It is also known that some earthquake emergency operation control systems for an elevator utilize real-time seismic information provided by government agencies for providing earthquake emergency operation controls to elevator systems in a network. However, these systems also require large costs for long-term contracts with the government agencies as well as maintenance and management of facility.

Therefore, there exists in the art a need for providing an earthquake emergency operation control system for an elevator which can utilize seismic propagation prediction data obtained in advance of the arrival of an earthquake without incurring large costs and requiring complexities. There also exists in the art a need for providing an earthquake emergency operation control system applicable to any elevator system connected in a network, regardless of whether the elevator system has its own seismic sensor.

SUMMARY OF INVENTION

According to one aspect of the present invention, an emergency operation controller for an elevator is disclosed. The controller is connected to other emergency operation controllers of their respective elevators through network, and each controller constitutes a node in the network. The controller generates and transmits an emergency condition detection message to other controllers in the network which constitute adjacent nodes to the controller when the controller detects an emergency condition, and receives an emergency condition detection message from other controllers which constitute adjacent nodes to the controller in the network when other controllers detect an emergency condition. The emergency condition detection message includes a propagation count. The propagation count is configured to be decremented by one, each time one controller transmits the emergency condition detection message to other controllers which constitute next adjacent nodes. The emergency condition detection message is continuously transmitted until the propagation count reaches to zero. Each emergency operation controller is configured to perform an emergency operation based on a received emergency condition detection message, if the controller receives the emergency condition detection message prior to the detection of the emergency condition.

In some embodiments, the emergency condition is an earthquake and the emergency condition detection message is an earthquake detection message.

In some embodiments, each emergency operation controller performs an earthquake emergency operation based on its own detection of an earthquake if the controller does not receive any earthquake detection message at the time of detection of the earthquake.

In some embodiments, at least one controller in the network includes a seismic sensor installed in a hoistway.

In some embodiments, the earthquake detection message includes types of detected earthquake including P-waves and S-waves, the controller stops an elevator car at the nearest floor and resumes operation after a lapse of a predetermined time if the earthquake detection message indicates P-waves, and the controller completely stops elevator operations until it is reset manually if the earthquake detection message indicates S-waves.

In some embodiments, the controller generating the earthquake detection message sets the propagation count depending on the types of detected earthquake, and the propagation count for S-waves is set to a value less than that for P-waves.

In some embodiments, the propagation count for P-waves is set to a value between 3 and 5, and the propagation count for S-waves is set to 1 or 2.

In some embodiments, the controller includes a signal processing section for receiving seismic signals from a seismic sensor, a main control section for generating an earthquake detection message based on the received seismic signals from the signal processing section or performing an earthquake emergency operation based on any earthquake detection message received from other controllers, and a network control section for transmitting/receiving the earthquake detection message to/from other controllers which constitute adjacent nodes in the network.

In some embodiments, the controller is configured to periodically generate a distribution list for elevators which constitute adjacent nodes in the network in advance of a detection of an emergency condition.

In some embodiments, the emergency condition is a flood.

According to another aspect of the present invention, a method of controlling emergency operations of a plurality of elevators connected in a network is disclosed. Each elevator constitutes a node in the network. The method includes: detecting an emergency condition by at least one elevator in the network; generating an emergency condition detection message by the at least one elevator, the emergency condition detection message including a propagation count; transmitting the emergency condition detection message to other elevators in the network which constitute next adjacent nodes to the at least one elevator and decrementing the propagation count by one; and performing an emergency operation based on the emergency condition detection message. Transmitting the emergency condition detection message is performed until the propagation count reaches to zero.

In some embodiments, the emergency condition is an earthquake and the emergency condition detection message is an earthquake detection message.

In some embodiments, the method further includes performing an earthquake emergency operation based on its own detection of an earthquake if an elevator does not receive any earthquake detection message at the time of detection of the earthquake.

In some embodiments, the earthquake detection message further includes types of detected earthquake including P-waves and S-waves. The method further includes: stopping an elevator car at the nearest floor and resumes operation after a lapse of a predetermined time if the earthquake detection message indicates P-waves; and stopping operation of the elevator until it is reset manually if the earthquake detection message indicates S-waves.

In some embodiments, the method further includes: setting the propagation count to a value between 3 and 5 for P-waves; and setting the propagation count to 1 or 2 for S-waves.

In some embodiments, the method further includes periodically generating a distribution list for elevators which constitute adjacent nodes in the network. Generating a distribution list is performed by each of the elevators in the network in advance of a detection of an emergency condition. Transmitting the emergency condition detection message is performed based on the distribution list.

In some embodiments, the emergency condition is a flood.

These and other aspects of this disclosure will become more readily apparent from the following description and the accompanying drawings, which can be briefly described as follows.

BRIEF DESCRIPTION OF DRAWINGS

FIG. 2B is an example of "Ack Query" message.

FIG. 3B is an example of "Ack Response" message.

FIG. 5B is an example of "Earthquake Detected" message.

DESCRIPTION OF EMBODIMENTS

Figure 1:
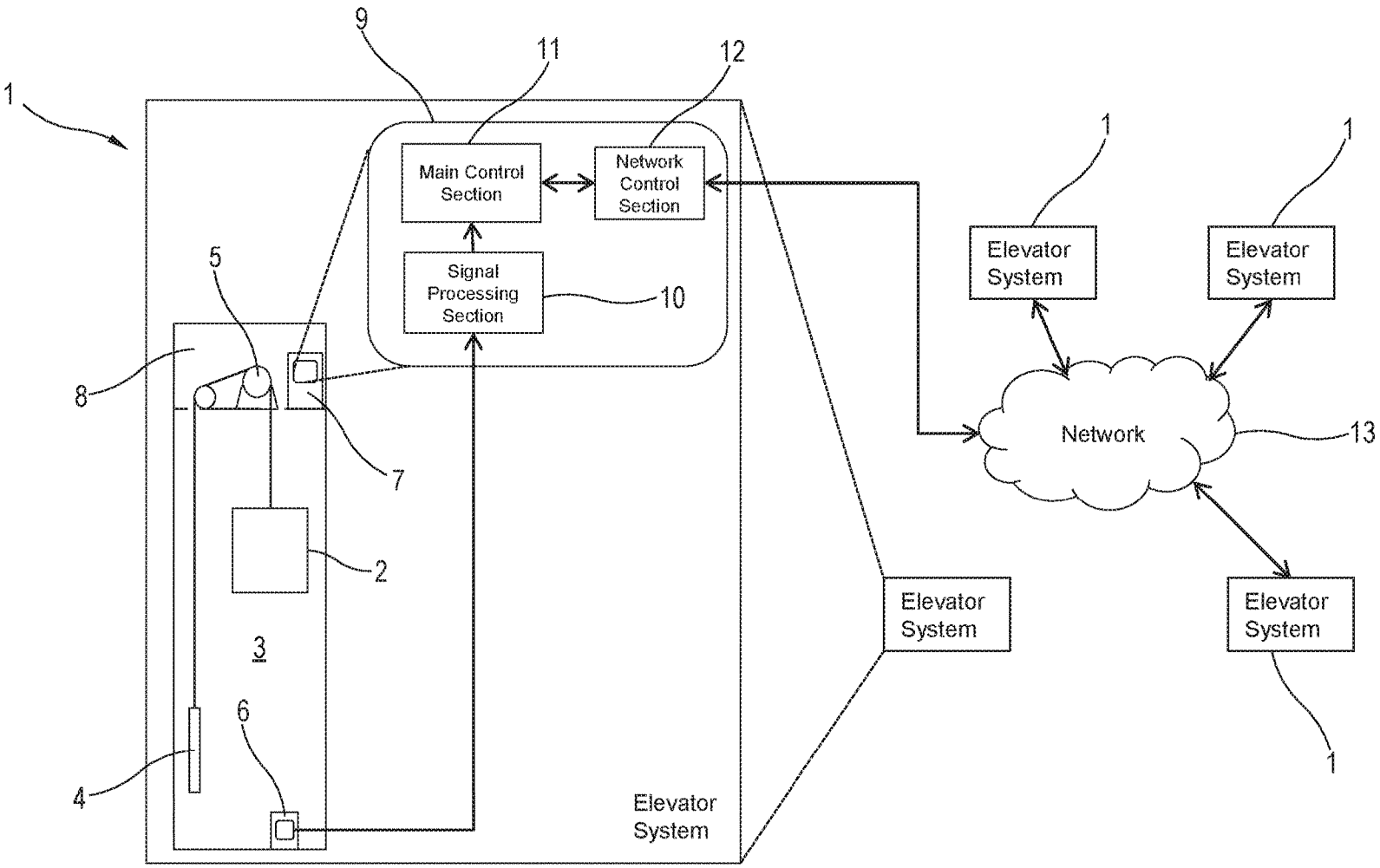
FIG. 1 is a schematic view showing one possible arrangement of an earthquake emergency operation control system in accordance with the present invention.

FIG. 1 shows a diagrammatic representation of various components of an earthquake emergency operation control system of an elevator system 1 in accordance with the present invention. The elevator system 1 includes an elevator car 2 configured to move vertically upward and downward within a hoistway 3. The elevator system 1 also includes a counterweight 4 operably connected to the elevator car 2 via a plurality of sheaves 5.

As shown in FIG. 1, the elevator system 1 further includes a seismic sensor 6 for detecting primary seismic waves (P-waves) and secondary seismic waves (S-waves), arranged within the hoistway 3. Seismic waves detected by the seismic sensor 6 are transmitted to a main controller 7 which is generally provided in a machine room 8 above the top floor of a building or provided in an operation control panel arranged at any specific location in a building.

The main controller 7 for controlling operations of the entire elevator system 1 includes an earthquake emergency operation controller 9 in accordance with the present invention. The earthquake emergency operation controller 9 includes a signal processing section 10 for receiving seismic signals from the seismic sensor 6, a main control section 11 for performing algorithms as described later, and a network control section 12 for transmitting/receiving messages to/from other elevator systems 1 connected via communication network 13.

As shown in FIG. 1, a plurality of elevator systems 1 installed in buildings in various areas are connected via network 13 and their earthquake detection data is shared with each other. By deploying an algorithm for consolidating data of elevator systems 1 in a certain area to generate distribution list in advance of a detection of an earthquake, the distribution list can be used to trigger earthquake emergency operation control within a limited range. It should be noted that the network 13 may include elevator systems 1 installed in buildings which do not have any seismic sensor 6.

When the seismic sensor 6 installed within the hoistway 3 detects seismic waves, the detected signals are transmitted through the signal processing section 10 to the main control section 11. The main control section 11 then generates a detection message and sends out the detection message through the network control section 12 to other elevator systems 1 in the network 13 based on the distribution list stored in the controller 9 of the sender elevator system 1. As will be described later, the detection message data includes a predetermined "Propagation Count" provided to be decremented by one, each time one elevator system 1 receives the detection message from another elevator system 1. This process is carried out until the propagation count reaches to zero. This process is called earthquake detection algorithm. By utilizing this algorithm, the elevators controlled in response to earthquake emergency operation control signals will be limited in a predetermined area.

Next, the algorithm for consolidating data of elevator systems 1 in various areas to generate distribution list will be described with reference to FIGS. 2A to 3B.

Figure 2A:
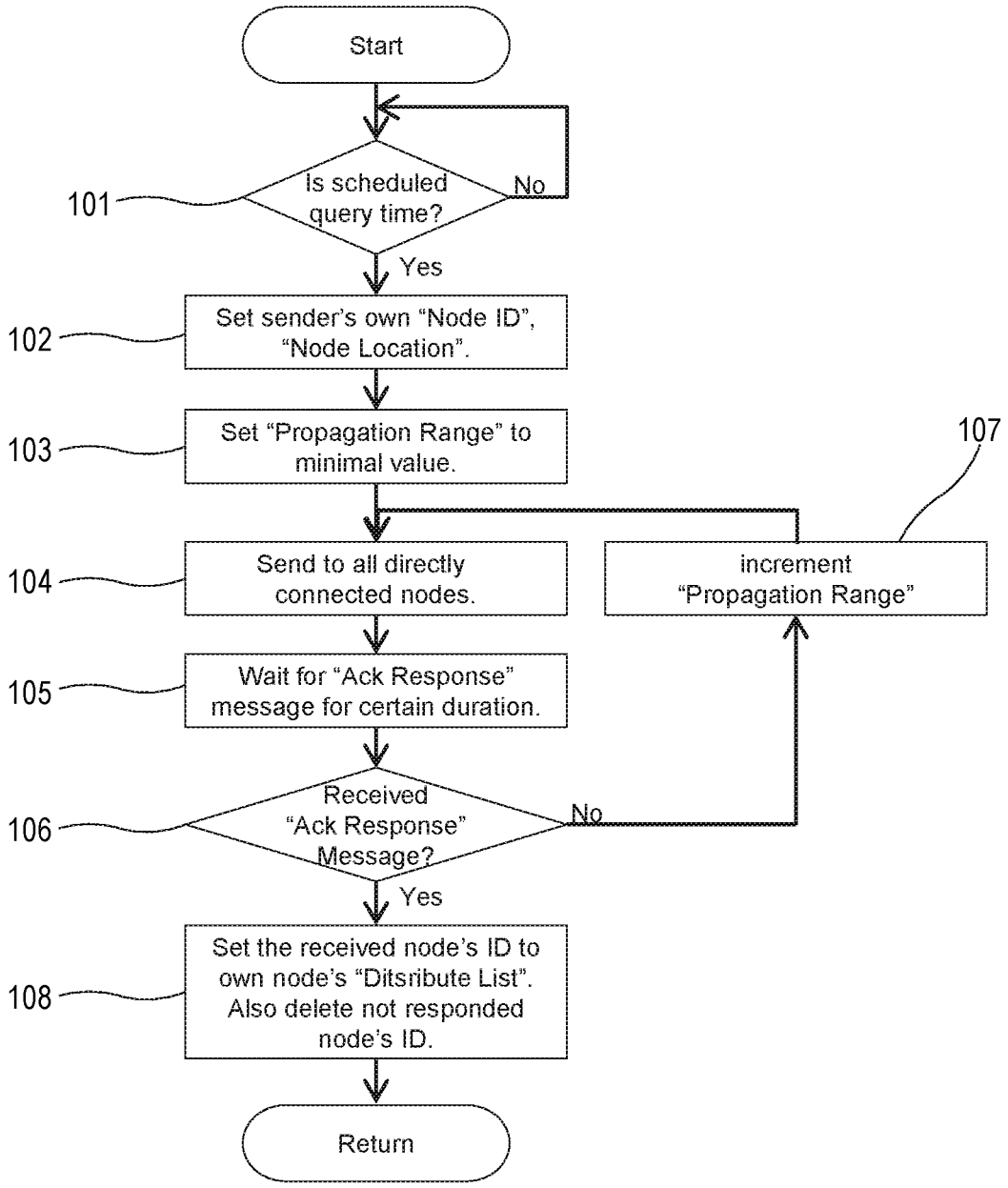
FIG. 2A is a flow diagram of exemplary operations for sending "Ack Query" message, performed by the earthquake emergency operation controller of the present invention.

FIG. 2A is a flowchart of exemplary operations performed by the earthquake emergency operation controller 9 of one elevator system 1 for sending "acknowledge query (Ack Query)" messages to generate distribution list of other elevator systems 1 installed in nearby buildings. The process begins at step 101 where the controller 9 determines if it is a scheduled query time. If yes, flow proceeds to step 102 where the acknowledge query message, as shown for example in FIG. 2B, is generated in the controller 9. At step 102, "Sender's Node ID" and "Sender's Node Location" is set in the message. Then, at step 103, "Propagation Range" is set to a minimal value, e.g. set to be within 1 km range. "Propagation Range" refers to a distance range of nearby elevator systems 1 from the sender elevator system 1 generating the "Ack Query" message.

Note that "Node" refers to one access point in a network. Thus, each elevator system 1 within the network 13 constitutes a node, and the next nodes refer to the next adjacent elevator systems 1 in the network 13 that are directly connected to the sender elevator system 1 in the network 13. The data, the Ack Query message in this case, can be transmitted to the next adjacent nodes, i.e. the next adjacent elevator systems 1.

Then, flow proceeds to step 104 where the Ack Query message is transmitted to all adjacent nodes, i.e. all elevator systems 1 directly connected to the sender elevator system 1 within the propagation range. At step 105, the controller waits for "Ack Response" message from the receiver elevator systems 1 for a certain period. At step 106, if no Ack Response message is sent back, then the controller increments "Propagation Range", e.g. by increasing the range from 1 km to 2 km, at step 107 and then sends the message again (step 104) and waits for a predetermined amount of time (step 105). This process may be repeated until the sender controller 9 collects specific amount of nodes (i.e. nearby elevator systems 1) and generates distribution list of the nearby elevator systems 1. Once the sender elevator 1 collects specific amount of nodes, then flow proceeds to step 108 to generate the distribution list of the nearby elevator systems 1 within the determined propagation range. At step 108, if there is any elevator system 1 that was listed in the previous distribution list but has no response at the present time, the controller 9 may delete its node ID from the distribution list. Once the step 108 is performed, the algorithm returns to step 101 to repeat process.

Figure 3A:
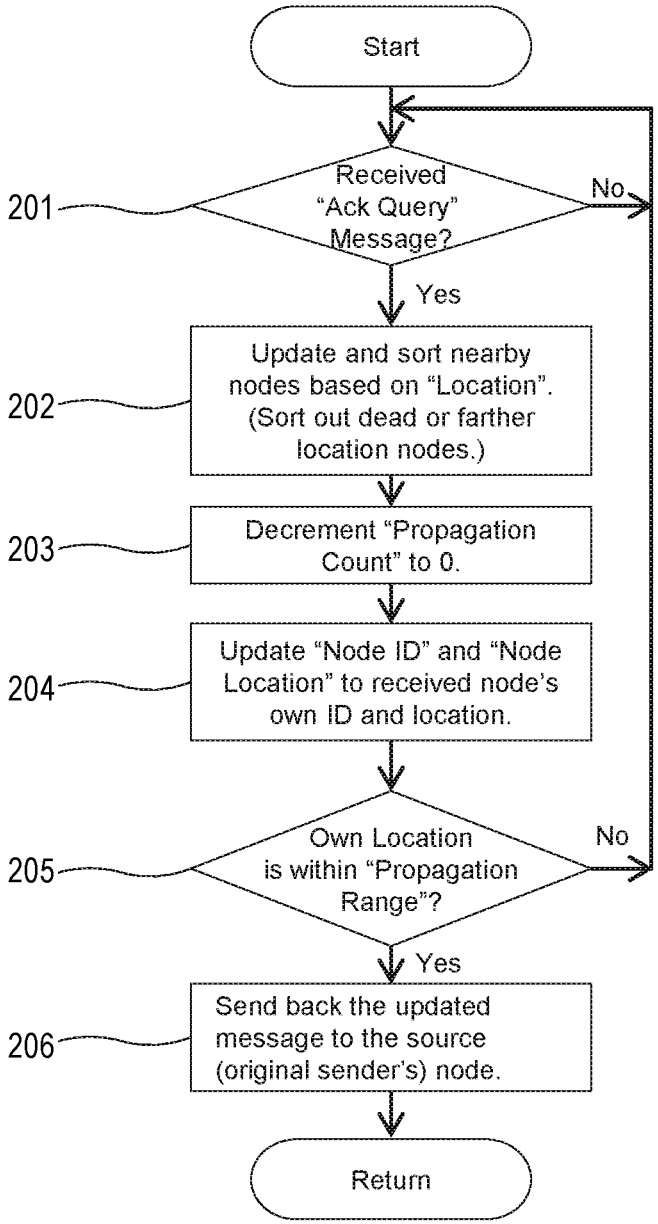
FIG. 3A is a flow diagram of exemplary operations for sending "Ack Response" message, performed by the earthquake emergency operation controller of the present invention.

FIG. 3A is an algorithm of exemplary operations performed by a receiver elevator system 1 upon receiving "Ack Query" message. The process begins at step 201 where the controller 9 determines if it receives "Ack Query" message. If not, flow returns to step 201 to repeat process. If the controller 9 receives any "Ack Query" message, then the controller 9 updates and sorts senders' nodes based on "Sender's Node ID" and "Sender's Node Location" at step 202. Then, the algorithm proceeds to step 203 where "Propagation Count" is decremented to zero, followed by generating "Ack Response" message as shown for example in FIG. 3B, including data regarding "Receiver's Node ID", "Receiver's Node Location" and "Propagation Count" at step 204. At step 205, it is determined whether the receiver elevator system 1 is located within the "Propagation Range" of the sender elevator system 1. If not, flow returns to step 201 to repeat process. If the receiver elevator system 1 is within the "Propagation Range", then the controller 9 of the receiver elevator system 1 sends back the updated "Ack Response" message to the sender elevator system 1 and the algorithm returns to step 201 to repeat process.

Note that "Propagation Count" refers to the number of times that "Ack Query" message as shown in FIG. 2B can pass from one elevator system to the next adjacent elevator systems connected in the network (i.e. next nodes in the network). Thus, "Propagation Count" is decremented by one, each time one elevator system receives the detection message from another adjacent elevator system. In this case, since "Propagation Count" is set to 1, "Act Query" message is transmitted to the adjacent elevator systems in the network just one time.

Next, a process for generating distribution list of elevator systems 1 in nearby areas will be described with reference to FIGS. 4A to 4D.

Figure 4A:
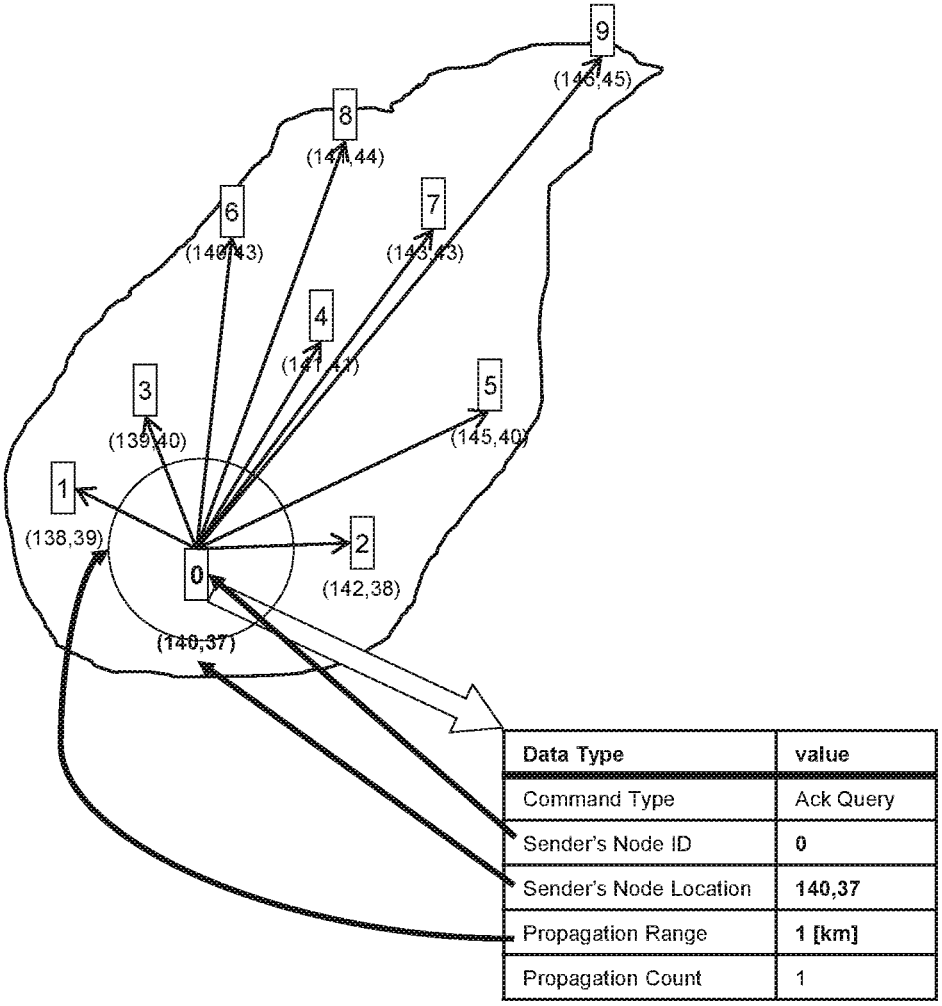
FIGS. 4A to 4D illustrate a process for generating "Distribution List" of elevator systems in an area.
Figure 4B:
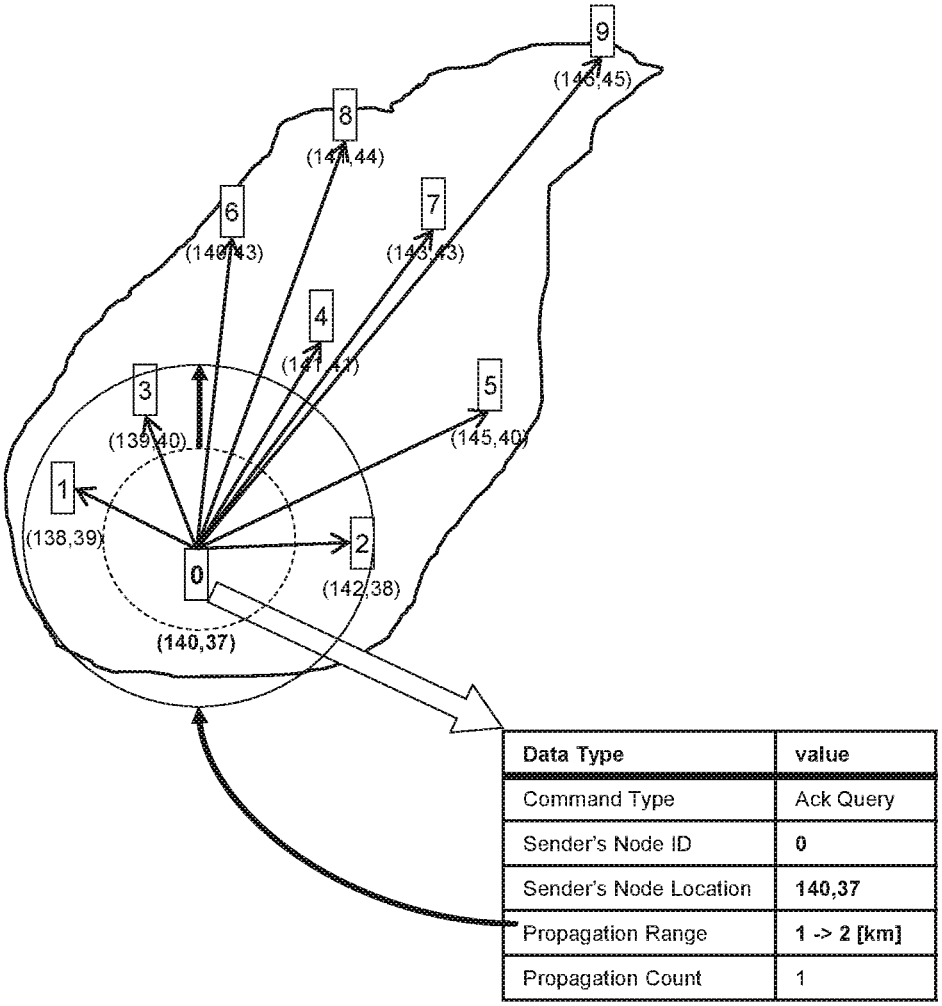
Figure 4C:
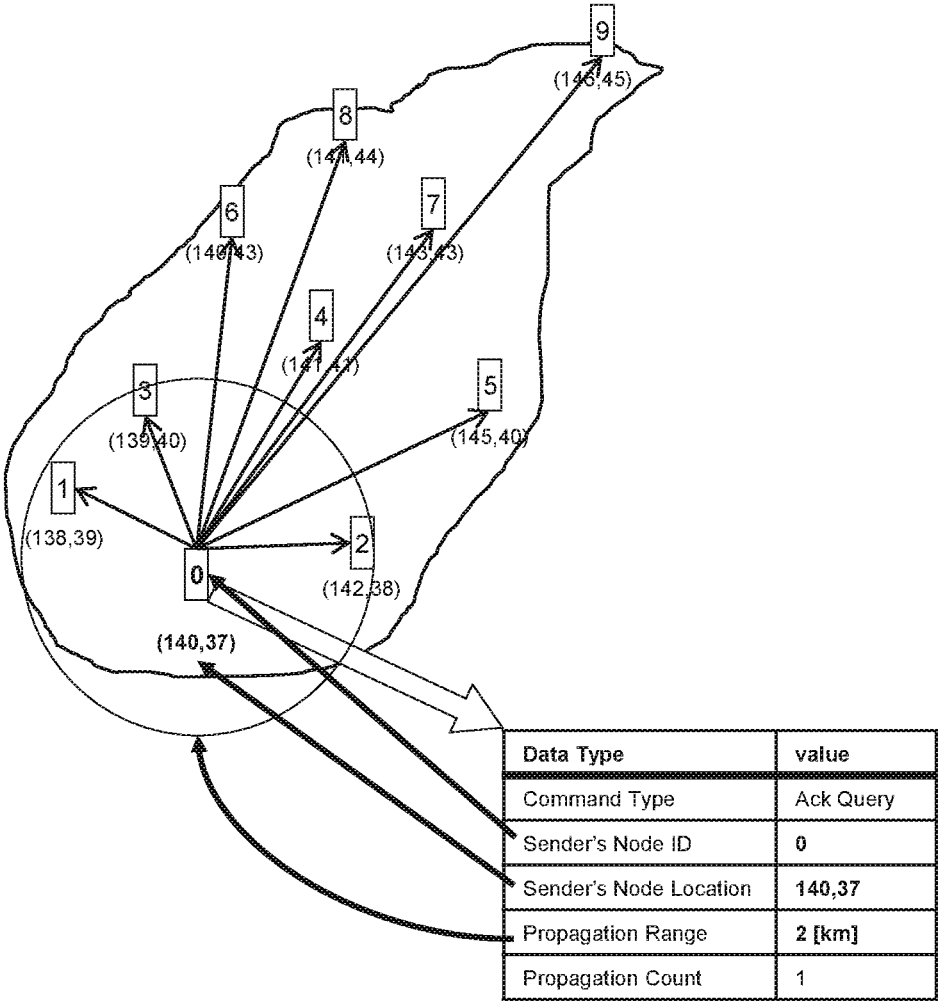
Figure 4D:
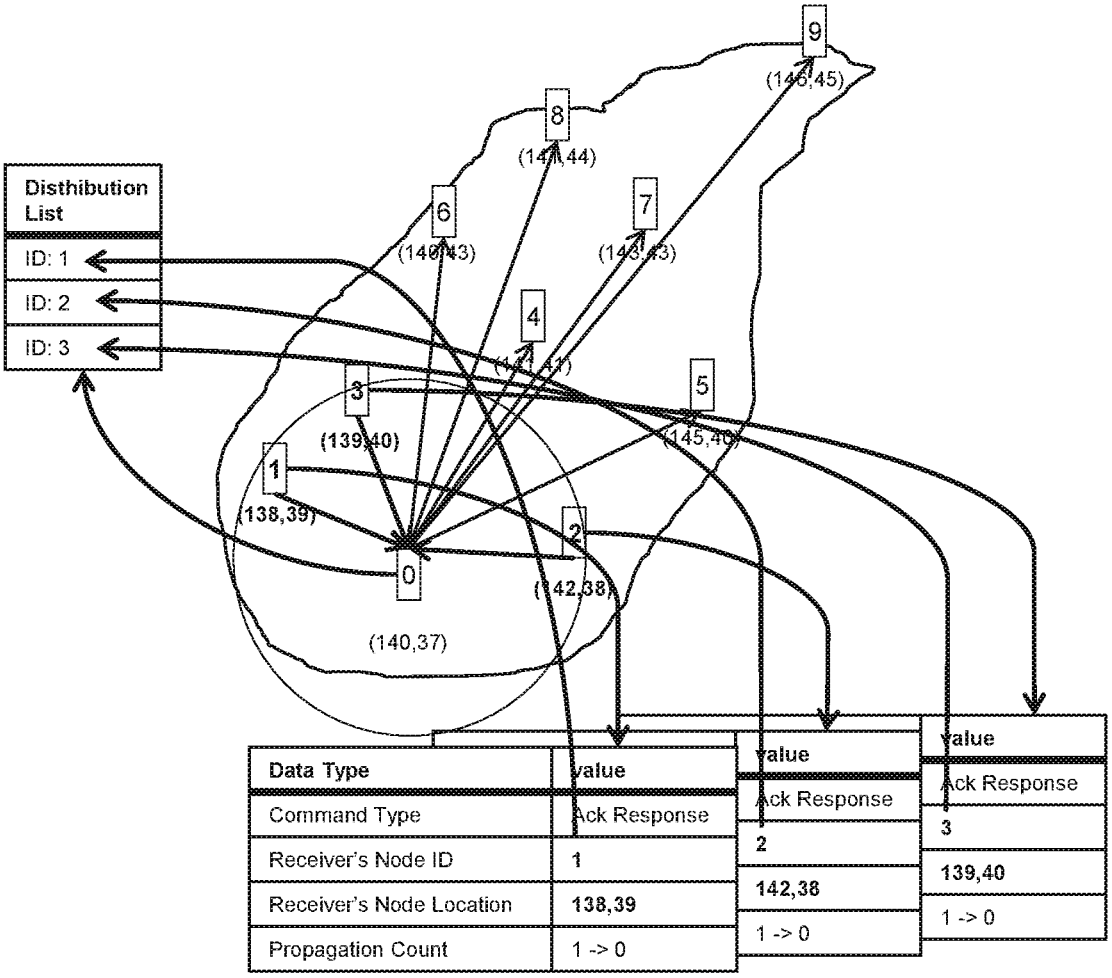

Assuming that there are ten elevators in a city that are connected together in a network 13 and one elevator with ID number 0 (hereinafter referred to as "elevator #0") is performing the distribution list generating algorithm as shown in FIG. 2A, with the propagation range of 1 km. In this case, as shown in FIG. 4A, since the propagation range is too small and there is no elevator within the range, no "Ack Response" message is sent back to the elevator #0. Then the elevator #0 increments "Propagation Range", e.g. by increasing from 1 km to 2 km, as shown in FIG. 4B. In this case, as shown in FIG. 4C, since there are three elevator systems #1, 2 and 3 within the propagation range of 2 km, the elevator #0 receives "Ack Response" messages from the elevators #1, 2 and 3 (FIG. 4D) and then consolidates these data to generate distribution list. It should be understood that each of all elevator systems 1 in the network 13 generates this algorithm and thus each building connected in the network 13 includes its own distribution list.

Next, the earthquake emergency operation control method in accordance with the present invention will be described with reference to FIGS. 5A to 6.

Figure 5A:
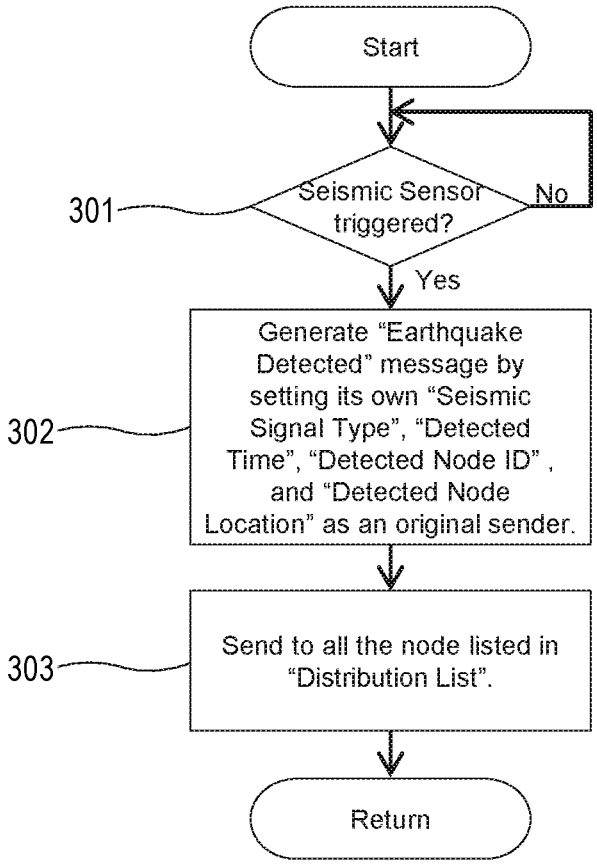
FIG. 5A is a flow diagram of exemplary operations for sending 7"Earthquake Detected" message, performed by the earthquake emergency operation controller of the present invention.

FIG. 5A is a flowchart of exemplary operations performed by the controller 9 upon detection of an earthquake. The process begins at step 301 where the controller 9 determines if the seismic sensor 6 detects an earthquake. If no earthquake has occurred, the main controller 7 stays in normal operation mode. If the seismic sensor 6 detects any seismic signal, flow proceeds to step 302 where the controller 9 generates "Earthquake Detected" message, as shown for example in FIG. 5B, by setting its own "Seismic Signal Type", "Detected Time", "Detected Node ID" and "Detected Node Location" as an original sender. "Seismic Signal type" refers to types of seismic waves detected by the seismic sensor 6, basically, P-waves and S-waves, as will be described later. "Propagation Count" is set by the original sender controller 9. "Propagation Count" constitutes a part of "Earthquake Detected" message. The flow then proceeds to step 303 where the "Earthquake Detected" message is transmitted to all the nodes (i.e. the nearby elevator systems 1) listed in the "Distribution List".

Figure 6:
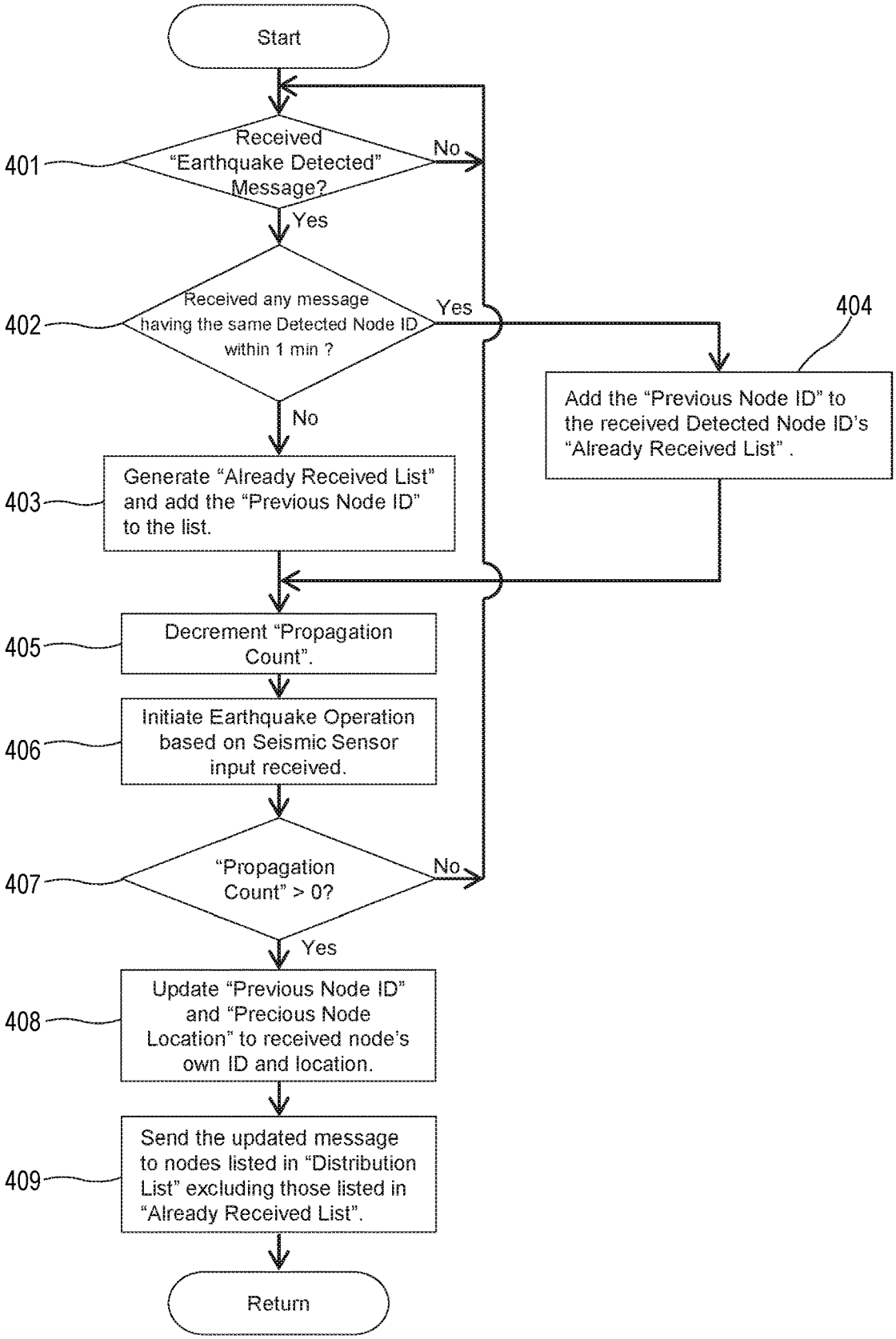
FIG. 6 is a flow diagram of exemplary operations for responding to the received "Earthquake Detected" message, performed by the earthquake emergency operation controller of the present invention.

FIG. 6 illustrates a flow diagram of exemplary operations performed by the controller 9 of a receiver elevator system 1 upon receiving the "Earthquake Detected" message as shown in FIG. 5B, from a nearby elevator system 1. The process begins at step 401 where the controller 9 determines if it receives any "Earthquake Detected" message from nearby nodes, i.e. any elevator systems 1 in the network 13. If not, the process returns to step 401 to repeat process.

If the controller 9 receives any "Earthquake Detected" message from nearby nodes (i.e. nearby elevator systems 1), flow proceeds to step 402 where the controller 9 checks to see if there is any other "Earthquake Detected" message (as shown for example in FIG. 5B) having the same "Detected Node ID" that was received within a predetermined time period, e.g. within one minute. If not, the controller 9 carries out the step 403 to generate "Already Received List" for the detected Node ID and add the "Previous Node ID" in the message to the "Already Received List".

On the other hand, if the controller 9 detects that there is any other "Earthquake Detected" message having the same "Detected Node ID" within one minute, flow proceeds to step 404 where the "Previous Node ID" in the currently received "Earthquake Detected" message is added to the existing "Already Received List" for the same detected Node ID.

For example, assuming that the elevator #0 has initially detected an earthquake and then its "Earthquake Detected"

message is firstly sent to three elevators #3, 4 and 5, and then each of the elevators #3, 4 and 5 sends out that "Earthquake Detected" message to the nearby elevator #7 within one minute. In this case, the elevator #7 receives three analogous messages having the same "Detected Node ID" listed as 0 but having three different "Previous Node ID" listed as 3, 4 and 5. Thus, the controller 9 in the elevator #7 carries out step 404 to add the "Previous Node ID": 3, 4 and 5 to the "Already Received List" for the "Detected Node ID"=elevator #0.

In addition, "Already Received List" may be deleted if 1 miniute has passed after the list is generated in order to save available memory in the controller 9.

Following the execution of steps 403 and 404, flow proceeds to step 405 to decrement "Propagation count" by one.

Note that "Propagation Count" refers to the number of times that "Earthquake Detected" message as shown in FIG. 5B can pass from an elevator system to the next adjacent elevator systems connected in the network (i.e. next nodes in the network). Thus, "Propagation Count" is decremented by one, each time one elevator system receives the detection message from another adjacent elevator system. This process is carried out until the propagation count reaches to zero. Propagation count is determined by the original sender controller 9, which may be selected depending on the total number of the elevators 1 connected in the network 13, the covered area of the network 13, types of seismic waves, magnitude of an earthquake, etc.

Subsequently, flow proceeds to step 406 where the controller 9 initiates an earthquake emergency operation based on "Seismic Signal Type" in the received "Earthquake Detected" message as shown in FIG. 5B.

It is known that there are mainly two types of seismic waves, i.e. primary seismic waves (P-waves) and secondary seismic waves (S-waves). P-waves have lower amplitude and are involved in preliminary tremors. In contrast, S-waves have significantly larger amplitude than P-waves and are involved in main destructive waves. P-waves travel much faster than S-waves, while S-waves travel at a relatively slow rate. Thus, there is usually a time lag between arrival of P-waves and S-waves, and it takes a longer time for S-waves to arrive at a detection point as the point gets farther away from the epicenter of an earthquake. Accordingly, by controlling the elevator system 1 to stop at the nearest floor upon receiving P-waves detection, passenger safety can be assured. Moreover, since transmission speed of the detection message is much faster than S-waves velocity, it is ensured that serious damage to the elevator systems 1 caused by S-waves can be prevented while assuring passenger safety.

If the received "Seismic Signal Type" is "P" waves, then the controller 9 triggers P-waves operation to stop the elevator car 2 at the nearest floor in order to allow passengers to evacuate. The operation of the elevator system 1 may be automatically resumed after a lapse of a predetermined time. If the received "Seismic Signal Type" is "S" waves, the controller 9 triggers S-waves operation to immediately transmits a signal to a main controller 7 to completely stop elevator operation. S-waves operation may generally be reset manually by elevator maintenance personnel to resume operation.

At step 407, the controller 9 checks to see if "Propagation Count" is not zero. If "Propagation Count" reaches to zero, the algorithm returns to step 401 to repeat process. If "Propagation Count" does not reach to zero, the algorithm proceeds to step 408 where the controller 9 updates the received "Earthquake Detected" message by updating "Previous Node ID" and "Previous Node Location" with the received node's (i.e. the receiver elevator system's) own Node ID and its own Node location.

Then, at step 409, the controller 9 sends out the updated "Earthquake Detected" messages to the elevator systems 1 listed in the "Distribution List", except for the elevator systems 1 listed in "Already Received List". Following the execution of step 409, this algorithm completes and returns to step 401 to repeat process.

It should be noted that each controller 9 is configured to perform an earthquake emergency operation based on its own detection of an earthquake if the controller 9 does not receive any earthquake detection message at the time of detection of the earthquake. In this regard the controller 9 may initiates the operation as shown in FIG. 5A, simultaneously with its elevator system's own earthquake emergency operation control.

Next, a propagation process of the earthquake emergency operation control in a network in accordance with the present invention will be described with reference to FIGS. 7 to 9.

Figure 7:
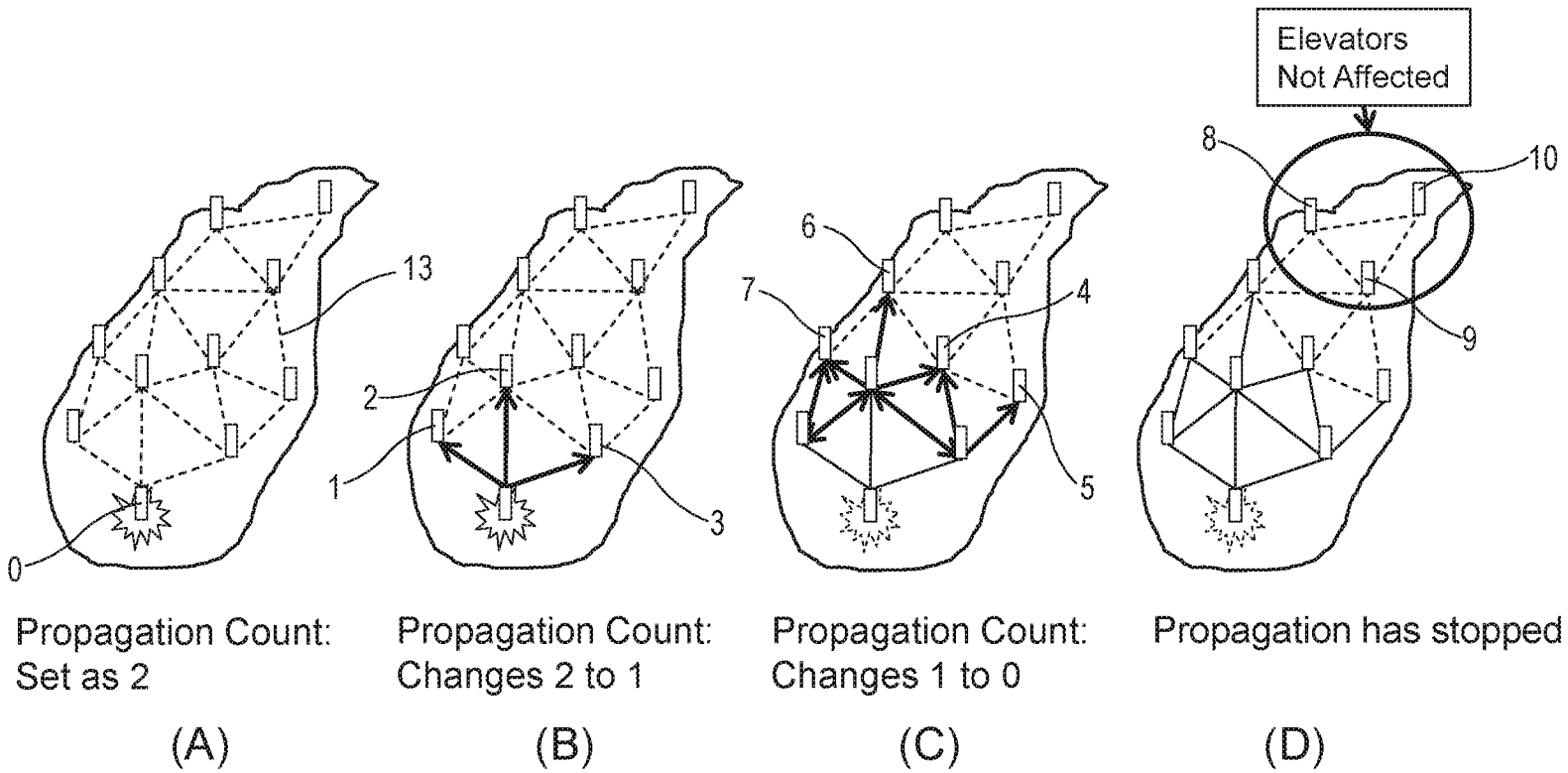
FIG. 7 is an exemplary propagation process of the earthquake emergency operation control in an area, where "Propagation Count" is set to 2.

FIG. 7 shows a case where the propagation count is set to 2. When one elevator #0 detects an earthquake (step A), the elevator #0 sends out the "Earthquake Detected" message to the next adjacent elevators #1, 2 and 3 (next nodes) in the network 13 and "Propagation Count" is decremented from 2 to 1 (step B). Subsequently, the received elevators #1, 2 and 3 further send out the received "Earthquake Detected" messages to their next adjacent elevators #4, 5, 6 and 7 (next nodes) in the network 13 (step C) and "Propagation Count" is decremented from 1 to 0. At this moment, since "Propagation Count" reaches to zero, the propagation process of the earthquake emergency operation is stopped and, as shown in step (D), there are some elevators #8, 9 and 10 left in the area connected together in the network 13 that remain in a normal operation mode.

Figure 8:
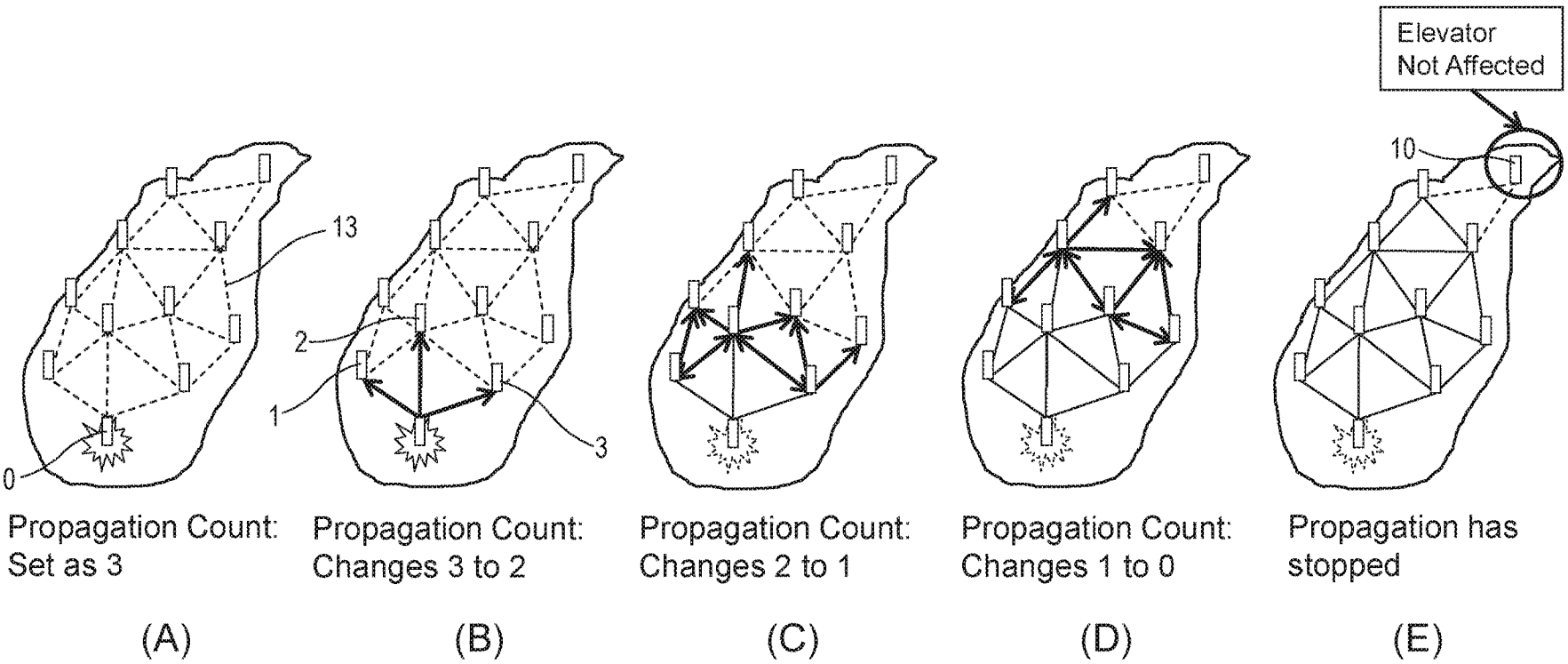
FIG. 8 is an exemplary propagation process of the earthquake emergency operation control in an area, where "Propagation Count" is set to 3.

FIG. 8 shows a case where propagation count is set to 3. In this case, when one elevator #0 detects an earthquake (step A), the elevator #0 sends out the "Earthquake Detected" messages to the next adjacent elevators #1, 2 and 3 in the network 13 and "Propagation Count" is decremented from 3 to 2 (step B). Similarly, the received elevators further send out the received "Earthquake Detected messages" to the next adjacent elevators until "Propagation Count" reaches to zero (steps C and D). At step E, the propagation process is stopped and only one elevator #10 is left in the area that remains in a normal operation mode.

In accordance with the present invention, by appropriately selecting "Propagation Count" depending on an area to be covered, the total number of the elevators connected in the network 13, types of seismic waves, magnitude of an earthquake, etc., the elevators controlled in response to earthquake emergency operation control signals will be limited in a predetermined area. For example, "Propagation Count" for P-waves may be set to a value between 3 and 5, and for S-waves may be set to 1 or 2, in order to prevent earthquake detection messages from endlessly transmitting in the network 13. It should be understood that any "Propagation Count" for detected seismic signals may be selected, provided that the propagation count for S-waves is set to a value less than that for P-waves.

Figure 9:
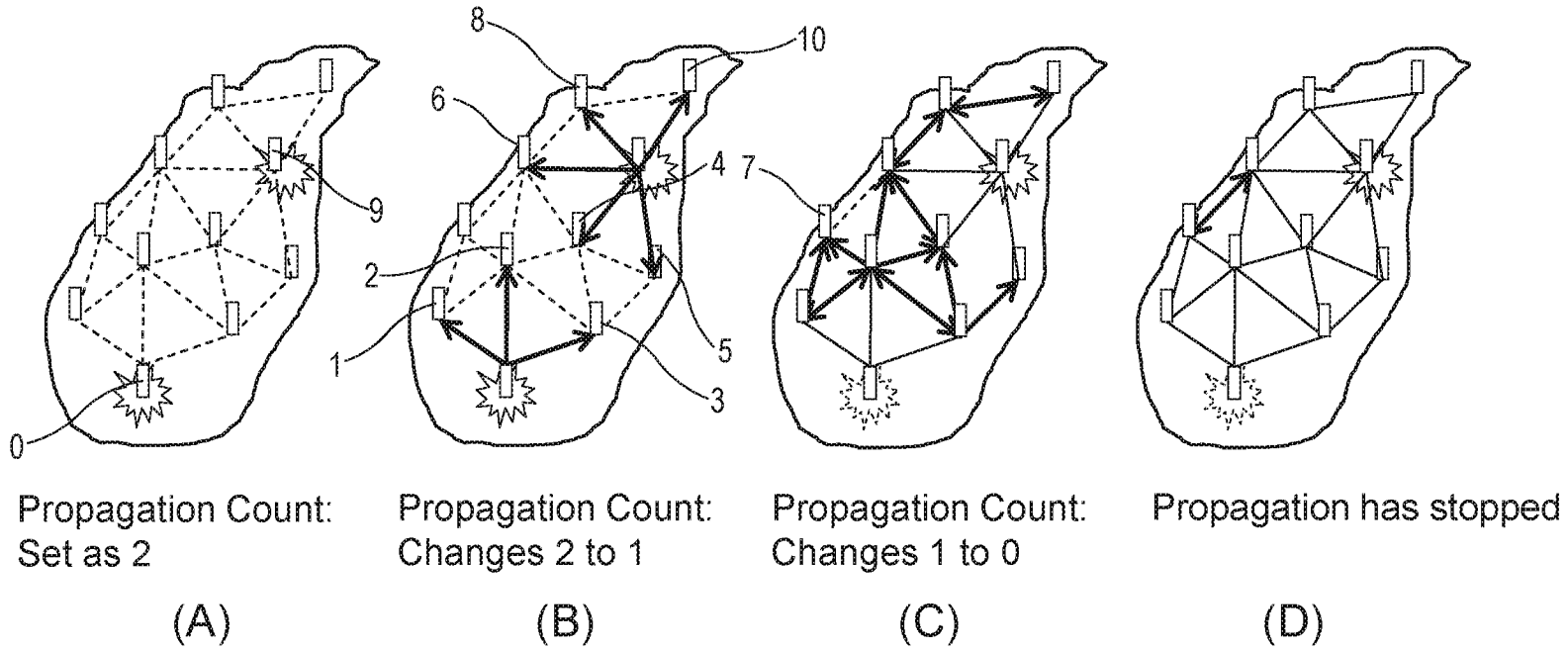
FIG. 9 is an exemplary propagation process of the earthquake emergency operation control in an area, where multiple detection points detect an earthquake.

FIG. 9 illustrates a case where propagation count is set to 2, and a relatively large earthquake strikes the area covered by the network 13. In this case, multiple elevator systems #0 and 9 initially detect the earthquake with a slight time difference and transmit "Earthquake Detected" messages to the next adjacent elevator systems #1, 2 and 3 and #4, 5, 6, 8 and 10 based on their respective distribution lists (step B). Thus, the earthquake emergency operation control signal is immediately transmitted to the entire elevator systems in the network (step C) and each elevator system initiates earthquake emergency operation at once (step D).

Similarly, as each of the elevator systems #1, 2 and 3 detects the earthquake following the detection of the earthquake by the elevator system #0, each of the elevator systems #1, 2 and 3 also generates "Earthquake Detected" message as an original sender.

In accordance with the present invention, the earthquake emergency operation control is controlled in a so-called peer-to-peer manner, with each elevator system 1 in the network 13 performing its own earthquake emergency operation controls, and their earthquake detection data is shared by all elevator systems 1 in the network 13. In other words, there is no central management server in a network. Accordingly, by utilizing the earthquake emergency operation control in accordance with the present invention, the cost and complexity required for maintenance and management of facility can be significantly reduced, comparing to conventional earthquake emergency operation control systems utilizing a central management server in a remote monitoring center.

Furthermore, the earthquake emergency operation control in accordance with the present invention may be applicable to any elevator system connected in a network, regardless of whether the elevator system has its own seismic sensor.

In addition, the emergency operation control system in accordance with the present invention may also be applicable to other emergency conditions. For example, the emergency operation controller 9 may include a flood sensor installed in the hoistway 3 for detecting a flood condition due to localized torrential rain, etc. In this case, the controller 9 may transmit an emergency condition detection message indicative of the flood condition to other controllers 9 in the network 13 for providing an emergency operation control to various elevator systems 1 located in a heavy precipitation area, in order to assure passenger safety.

While the present invention has been particularly shown and described with reference to the exemplary embodiments as illustrated in the drawings, it will be recognized by those skilled in the art that various modifications may be made without departing from the spirit and scope of the invention as disclosed in the accompanying claims.

What is claimed is:

1. An emergency operation controller for an elevator, the controller connected to other emergency operation controllers of respective elevators through a network, each controller constituting a node in the network, wherein the controller generates and transmits an emergency condition detection message to other controllers in the network which constitute adjacent nodes to the controller when the controller detects an emergency condition, and receives an emergency condition detection message from other controllers which constitute adjacent nodes to the controller in the network when at least one of the other controllers detect an emergency condition, wherein an emergency condition detection message includes a propagation count, the propagation count configured to be decremented by one, each time one controller transmits the emergency condition detection message to other controllers which constitute next adjacent nodes, and the emergency condition detection message is continuously transmitted until the propagation count reaches to zero, and wherein each controller is configured to perform an emergency operation based on the received emergency condition detection message in response to the controller receiving the emergency condition detection message prior to the detection of the emergency condition.

2. The controller of claim 1, wherein the emergency condition is an earthquake and the emergency condition detection message comprises an earthquake detection message.

3. The controller of claim 2, wherein each controller performs an earthquake emergency operation based on a controller's own detection of an earthquake in response to the controller not receiving any earthquake detection message at a time of detection of the earthquake.

4. The controller of claim 2, wherein at least one controller in the network includes a seismic sensor installed in a hoistway.

5. The controller of claim 2, wherein the earthquake detection message includes types of detected earthquake including P-waves and S-waves, the controller stops an elevator car at a nearest floor and resumes operation after a lapse of a predetermined time in response to the earthquake detection message indicating P-waves, and the controller completely stops elevator operations until it is reset manually in response to the earthquake detection message indicating S-waves.

6. The controller of claim 5, wherein the controller generating the earthquake detection message sets the propagation count depending on the type of detected earthquake, and wherein the propagation count for S-waves is set to a value less than that for P-waves.

7. The controller of claim 6, wherein the propagation count for P-waves is set to a value between 3 and 5, and the propagation count for S-waves is set to 1 or 2.

8. The controller of claim 2, wherein the controller includes:

a signal processing section for receiving seismic signals from a seismic sensor;

a main control section for generating the earthquake detection message based on the received seismic signals from the signal processing section or performing an earthquake emergency operation based on any earthquake detection message received from other controllers; and a network control section for transmitting/receiving the earthquake detection message to/from other controllers which constitute adjacent nodes in the network.

9. The device of claim 1, wherein the controller is configured to periodically generate a distribution list for elevators, the distribution list comprising adjacent nodes in the network in advance of a detection of an emergency condition.

10. The device of claim 1, wherein the emergency condition is a flood.

11. A method of controlling emergency operations of a plurality of elevators connected in a network, each elevator constituting a node in the network, the method comprising:

detecting an emergency condition by at least one elevator in the network;

generating an emergency condition detection message by the at least one elevator, the emergency condition detection message including a propagation count;

transmitting the emergency condition detection message to other elevators in the network which constitute next adjacent nodes to the at least one elevator and decrementing the propagation count by one; and performing an emergency operation based on the emergency condition detection message, wherein the transmitting the emergency condition detection message is performed until the propagation count reaches to zero.

12. The method of claim 11, wherein the emergency condition is an earthquake and the emergency condition detection message comprises an earthquake detection message.

13. The method of claim 12, further including:

performing an earthquake emergency operation based on an elevators' own detection of an earthquake in response to an elevator not receiving any earthquake detection message at a time of detection of the earthquake.

14. The method of claim 12, wherein the earthquake detection message further includes types of detected earthquake including P-waves and S-waves, further including:

stopping an elevator car at a nearest floor and resuming operation after a lapse of a predetermined time in response to the earthquake detection message indicating P-waves; and stopping operation of the at least one elevator until the at least one elevator is reset manually in response to the earthquake detection message indicating S-waves.

15. The method of claim 14, further including:

setting the propagation count to a value between 3 and 5 for P-waves; and setting the propagation count to 1 or 2 for S-waves.

16. The method of claim 11, further including:

periodically generating a distribution list for elevators which constitute adjacent nodes in the network, wherein the generating the distribution list is performed by each of the elevators in the network in advance of the detection of the emergency condition, and wherein the transmitting the emergency condition detection message is performed based on the distribution list.

17. The method of claim 11, wherein the emergency condition is a flood.

* * * * *